United States Patent [19]

Ohrt

[11] Patent Number: 4,954,048

[45] Date of Patent: Sep. 4, 1990

[54] PROCESS AND DEVICE FOR CONVEYING BOILABLE LIQUIDS

[75] Inventor: Dirk Ohrt, Stolberg, Fed. Rep. of Germany

[73] Assignee: Rendamax BV, Netherlands

[21] Appl. No.: 292,335

[22] Filed: Dec. 30, 1988

[30] Foreign Application Priority Data

Dec. 30, 1987 [DE] Fed. Rep. of Germany ..... 3744487

[51] Int. Cl.[5] ..... F04B 19/24

[52] U.S. Cl. ..... 417/209

[58] Field of Search ..... 417/209, 208, 207, 379, 417/375; 60/531

[56] References Cited

U.S. PATENT DOCUMENTS 3,285,001 11/1966 Turnblade ..... 417/208

*Primary Examiner*—Leonard E. Smith

*Attorney, Agent, or Firm*—Watson, Cole, Grindle & Watson

[57] ABSTRACT

A process for conveying boilable liquids wherein the required delivery pressure is generated by alternately changing the boiling pressure of a boilable liquid from a low starting point to a boiling pressure, increased by the desired increase in pressure, by an external heat input and then the original state is reproduced by reducing the pressure to the low boiling pressure by dissipating the heat externally, is improved by avoiding the use of highly stressed wearable parts and by being able to attain greater reliability and longer life span with a faster method. For this purpose, in the vessel through which the boilable liquid to be conveyed flows a subquantity of the boilable liquid being conveyed is subjected directly to the work performing cyclic process in the wet steam region. The device includes a vessel to which are connected closable inlet and outlet lines and whose bottom region has a lower temperature than the upper region, the walls of the vessel providing heat exchanger zones, and a displacement element for displacing the boundary layer of liquid and steam into zones of different temperature.

10 Claims, 4 Drawing Sheets

PROCESS AND DEVICE FOR CONVEYING BOILABLE LIQUIDS

BACKGROUND OF THE INVENTION

The present invention relates to sorption systems, and more particularly to processes and devices for conveying the boilable liquids used therein.

The invention relates to a process and a device for conveying boilable liquids in which process or in which device the required delivery pressure is generated by alternately changing the boiling pressure of a boilable liquid from a low starting point to a boiling pressure, increased by the desired increase in pressure by an external heat input, and then the original state is reproduced by reducing the pressure to the low boiling pressure by dissipating the heat externally, whereby the boilable liquid is subjected to a work-performing cyclic process in the wet steam region, which process comprises a reduction in pressure by means of dissipation of heat, compression by means of dissipating heat to a low temperature level, increase in pressure by means of a heat input, as well as an expansion to a higher temperature level through heat input, in particular in a sorption system (absorption refrigerating machine, absorption heat pump or absorption heat transformer and resorption refrigerating machine, resorption heat pump or resorption transformer).

The solution pump of a sorption system causes significant problems due to its construction. The pressure difference to be bridged is dependent on the pairs of substances comprising the refrigerant and solvent that are used. A frequently used pair of substances is $NH_3$ and $H_2O$ in which pressure differences of 20 bar and more can occur. The problems that arise in this case and that are similar in the case of many other pairs of substances are low efficiency and cavitation problems, as well as the expulsion of frequently environmentally harmful and/or poisonous refrigerant. Furthermore, the cost of these components, in particular in the case of large refrigeration and heat installations, when measured against the costs of the entire system, can be disproportionately high.

A process for operating absorption heat pumps is known from DD 219 060 wherein to save electric energy a solution pump, designed as a membrane, with a thermal drive part is used that comprises a closed vessel filled with a two substance mixture containing ammonia and water, in which process there is a temperature changer that is driven periodically with cold steam from the evaporator and with a warm medium from the circulating heat pump.

This kind of device requires that two heat exchangers be periodically heated and cooled. Thus, a slow and inefficient procedure is unavoidable because from time to time the entire heating and the entire cooling heat exchange system must be heated up or cooled down. Furthermore, due to the mandatory membrane that becomes stressed from continuous duty, its replacement is periodically necessary, which requires that the entire system be dismantled.

SUMMARY OF THE INVENTION

Therefore, the object of the invention is to provide a process and a device of the aforementioned kind in which there are no highly stressed wearable parts, in particular no membranes, and in which a faster and more efficient method of operation than in the known devices of this kind can be attained.

With respect to the process of the aforementioned kind the invention provides that in the vessel through which the boilable liquid to be conveyed flows, a subquantity of the boilable liquid that is conveyed is subjected directly to the work-performing cyclic process in the wet steam region.

The invention also provides a device for the conveyance of boilable liquids, in particular to carry out the described process, in which device there is a vessel provided with an inlet and an outlet that can be shut off and in whose bottom region the temperature is lower than in the top region, and including means to move the boundary layer of liquid and steam into zones of different temperature.

DETAILED DESCRIPTION OF THE PREFERRED EMBODIMENTS

Figure 1:
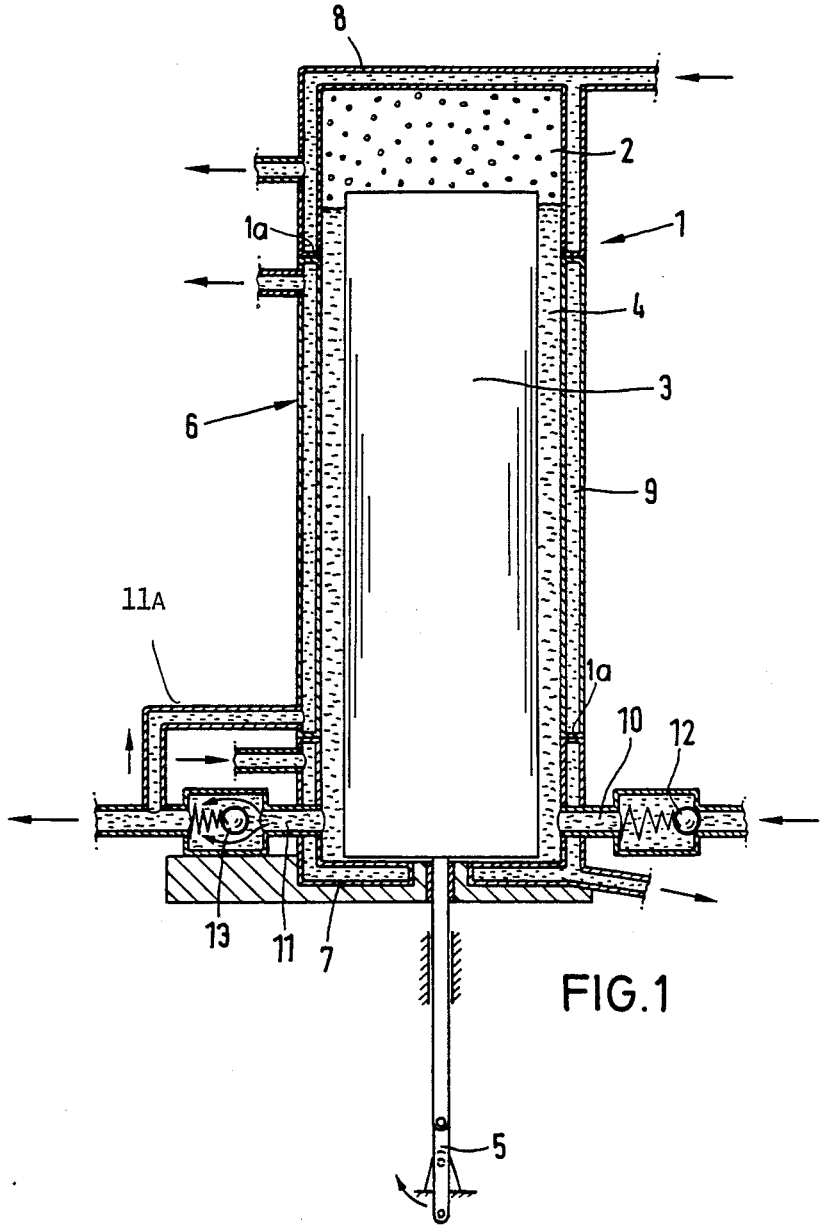
FIGS. 1 and 2 show identical side views of a first embodiment of a device for conveying boilable liquids according to the present invention, the displacement element in the vessel thereof being shown in two different operational positions.
Figure 2:
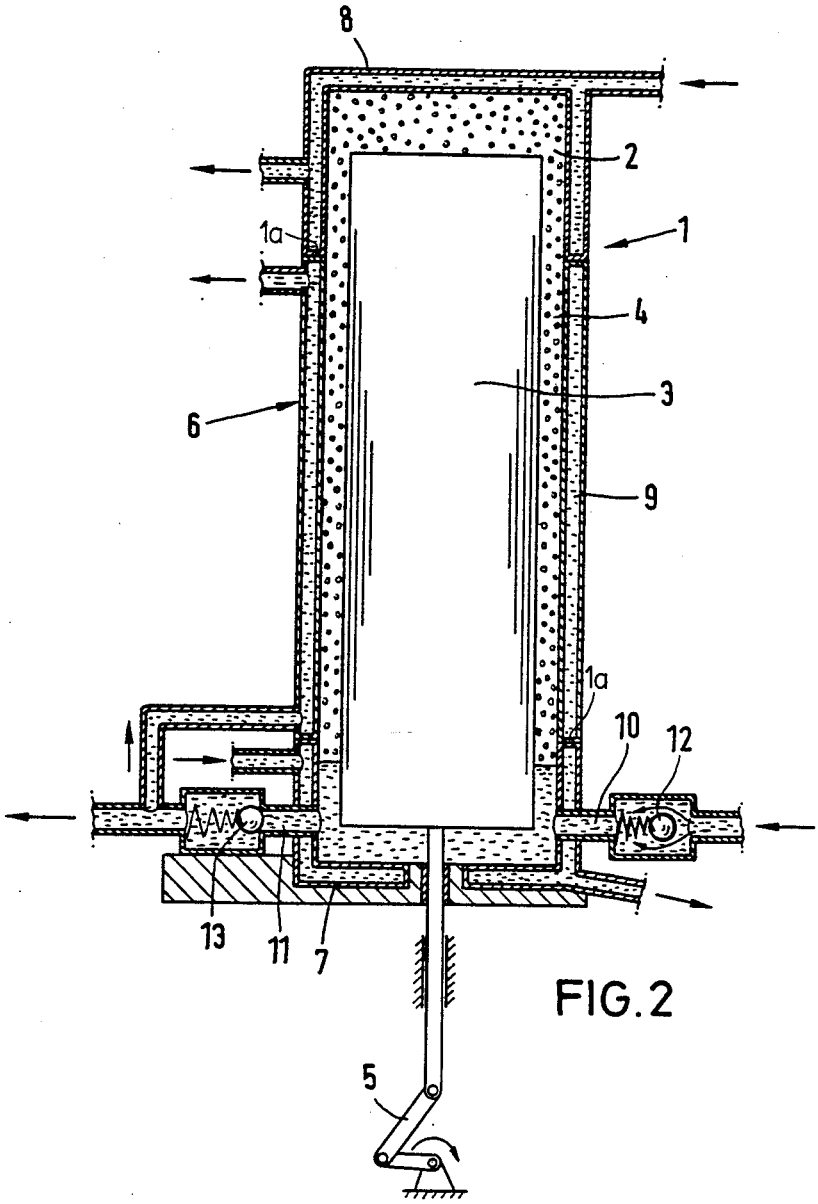

As indicated in FIGS. 1 and 2, the inventive device includes a vessel 1 defining an interior work space 2 and a displacement element 3 which is movably located in the work space 2 and dimensioned to provide a narrow annular gap 4 between it and the interior wall of the vessel 1. The displacement element 3 is reciprocatingly movable within the vessel 1 by a drive means 5. The side 6, bottom 7 and top 8 of the vessel 1 are formed of inner and outer walls which provide a fluid space therebetween, and partitions 1*a* are located between the walls to provide lower, middle and upper heat exchanger zones. An inlet means 10 which contains a back pressure valve 12 is connected through the inner and outer walls at the lower end of the vessel to enable low pressure liquid from a low pressure portion of a sorption system (not shown) to be supplied to the work space 2, and an outlet means 11 containing a back pressure valve 13 extends out of the vessel to supply high pressure fluid to a high pressure portion of the sorption system. A branch line 11*a* from the outlet means 11 connects to the middle heat exchanger along the wall portion 9 of the vessel to enable a flow of high pressure fluid to pass upwardly through the middle heat exchanger such that it functions as a regenerative heat exchanger having a temperature gradient along the length of the vessel (this high pressure fluid leaves the middle heat exchanger and passes to an adjoining heat exchanger). Suitable inlet and outlet pipes are connected to the lower and upper heat exchangers to enable respectively cold and hot fluid mediums to pass therethrough, such that they respectively function as "cold" and "hot" zones.

A liquid level forms within the annular gap 4 based on the position of the displacement element 3 in the work space. This liquid level can be regarded as the phase boundary between the upper steam phase and the liquid phase therebelow since (as will be described below) a residual mass of liquid and steam phases will always be present in the vessel. By providing zones of different temperatures along the walls of the vessel, each change in the liquid level (phase boundary) in the annular gap 4 results in either an input or a dissipation of heat and consequently a change in the temperature at the phase boundary. The temperature of this phase boundary, where in the ideal case there is constant phase equilibrium, is the sole relevant factor for the pressure in the entire vessel 1. As such, a specific vessel pressure is generally associated with the level of the phase boundary in the vessel. Thus, if the level of the phase boundary is displaced by the motion of the displacement element 3, the pressure in the vessel is changed to the same degree.

For the sake of simplicity the inventive process of conveying a boilable liquid will be explained by reference to an absorption heat pump utilizing $NH_3$ and $H_2O$. However the process is not limited to two substance mixtures.

The function of the inventive device is to convey the refrigerant-enriched solution which has been discharged from the absorber at a low absorber pressure (e.g. 4 bar) to a generator which is at a high pressure (e.g. 20 bar). In this process the pressure of the liquid, but not its temperature, is increased in order to reduce energy costs to a minimum. To facilitate the entry of the low pressure solution, the mixture remaining in the system, comprising steam and liquid, is cooled in the cold zone below the inlet temperature of this solution by passing cooling water, which is branched, e.g., prior to the absorber, and is therefore colder than the solution, through the vessel bottom 7 so that a subpressure relative to the absorber (e.g., 3.8 bar) is created in the vessel 1, whereby the back pressure valve 12 in the inlet means 10 opens. In order to be able to dispel the liquid raised to a high pressure from the vessel 1, a pressure relative to the generator must be produced in the vessel 1 (e.g., 20.2 bar) so that back pressure valve 13 in the outlet means 11 opens. This is brought about by the exchange of heat in the system by moving the level of the liquid up to the upper heat exchanger zone in the cover 8 of the vessel 1, such that the temperature of the liquid will become higher than the equilibrium temperature of the refrigerant at this pressure, for example the degassed solution after leaving the generator. In the following the state changes of the cyclic process for the system under discussion will be explained with reference to FIGS. 1 to 4.

In FIG. 1, corresponding to state (1), the displacement element 3 is illustrated in its bottom dead position. The volume of steam in the head of the vessel 1 represents the control volume, which in the following process goes through a cyclic process. The phase boundary level is in the hot zone; thus in comparison to the generator of the sorption system, excess pressure prevails in the vessel 1, whose top 8 is heated with a process-internal liquid of suitable temperature, so that the back pressure valve 13 in the outlet means 11 is opened. If the displacement element 3 is moved upward, the phase boundary between the liquid remaining in the work space and the associated steam phase moves in the direction of the lower temperatures. Since during the state change from (1) to (2), both back pressure valves 11, 12 are closed, this state change runs isochorically. A portion of the control volume, which in state (1) was steam, is liquefied in this state change and, thereby, deposits on the vessel wall a quantity of heat $q_{12}$.

When the liquid level reaches the cold zone (state (2) in FIG. 2), which is cooled with cooling water at a temperature lower than the entry temperature of the solution, the pressure of the vessel drops below the absorber pressure, whereby the back pressure valve 12 in the inlet means 10 is opened and the liquid level, and thus the pressure of the vessel, is prevented from dropping any further. As the displacement element 3 is moved further upwards, the vessel 1 is filled with a low pressure solution. In this case the position of the liquid level remains unchanged (isobaric, isothermal compression). The displacement element 3 continues to move upward to the top dead position (state (3) according to FIG. 3), and the thereby displaced steam from the control volume is liquefied, whereby the quantity of heat $q_{23}$ must be dissipated to the cooling water, which flows through lower heat exchanger in the vessel bottom 7.

Now the control volume from state (1) has been liquefied. In the process of the ensuing downward movement of the displacement element 3, the back pressure valve 12 in the inlet means 10 closes, since the phase boundary is displaced into the hot zone, so that the pressure of the vessel rises. Until maximum pressure (state (4) corresponding to FIG. 4) has been attained, this state change runs isochorically, whereby the liquid, rising in the cylindrical gap 4, absorbs the heat $q_{34}$ so that a portion of the liquefied control volume can be re-evaporated. With respect to quantity, the quantity of heat $q_{34}$ is significantly less than the quantity of heat $q_{12}$ which was stored by the vessel wall, so that the exchange of heat can be regenerated. When the pressure is higher than the generator pressure, the back pressure valve 13 in the outlet means 11 opens, and the solution is displaced from the bottom portion of the vessel 1 into the generator by means of a further downward movement of the displacement element 3 while maintaining the high pressure. In this case in the top 8 the heat $q_{42}$ must be put in from the solution passing through the upper heat exchanger, whereby more condensate from the control volume can be re-evaporated.

When the displacement element 3 has reached the bottom dead position, the entire solution minus the dead quantity, which remains in the annular gap 4 and is necessary for maintaining the high pressure, has been displaced into the generator. Thus the initial state (1) is reproduced. During the process of displacement into the high pressure part, the required quantity or a portion of the stream thereof can be guided into the cavity in the vessel wall and, thus, absorb the residual heat $q_{12}-q_{34}$.

When the process is carried out under ideal conditions, the energy required to drive the described device comprises the input of the specific quantity of heat $q_{41}$, and the comparatively slight volume change work $P_{23}$, which the liquid, flowing into the vessel 1, performs on the control volume. The process yields the volume change work $P_{41}$ on the displaced liquid and the heat $q_{23}$, which in the case of the example of an absorption heat pump, treated here, is dissipated as effective heat to the consumer and the difference of heat flows $q_{12}-q_{34}$. The increased cost in high temperature heat, which must also be generated with primary energy in the generator of a heat pump, amounts to:

$$Q_{Zu}=Q_{41}-(|Q_{12}|-|Q_{34}|)$$

The volume change work $P_{Nutz}$ can be generated with this expense. Moreover, the heat $q_{23}$ falls to the share of the effective temperature level.

To move the displacement element 3 in the ideal case no energy needs to be expended since this part performs no work. In practice, however, frictional forces and forces due to gravity, whose size is dependent on the engineering design of the drive 5 and the described device, must be overcome. However, this drive could also be actuated within the system, since the potential energy of the rich solution, which is at high pressure, from the generator, which is converted into lost heat prior to entry into the absorber on low pressure in a throttle, can be used for this purpose instead.

Figure 3:
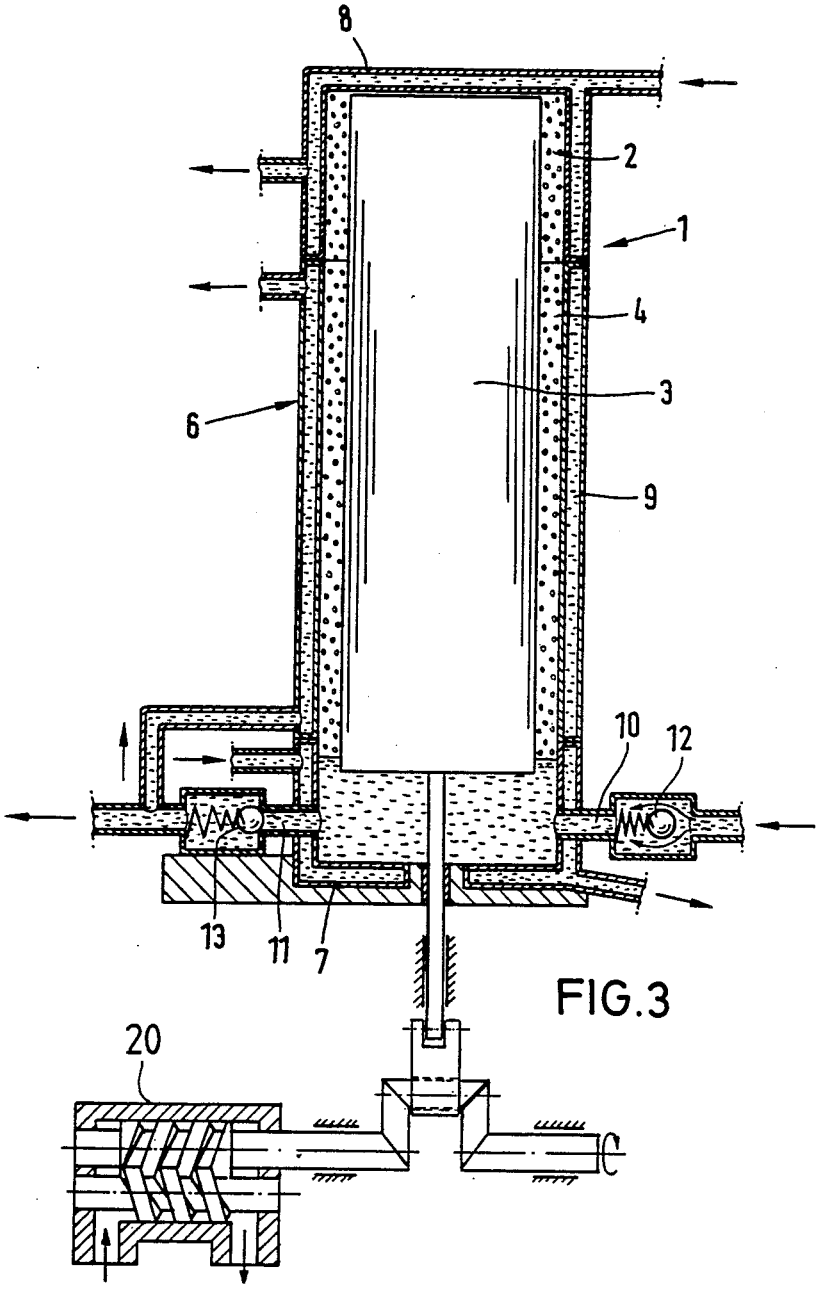
FIG. 3 shows a schematic side view of a second embodiment of a device according to the present invention, the displacement element in the vessel thereof being shown in a third operational position.

The design of the drive 5 shown in FIGS. 1 and 2 is merely one embodiment. As shown in FIG. 3, a hydraulic displacement unit 20 can also be used to move the displacement element 3, which utilizes the pressure energy of the liquid transport agent or solvent.

Figure 4:
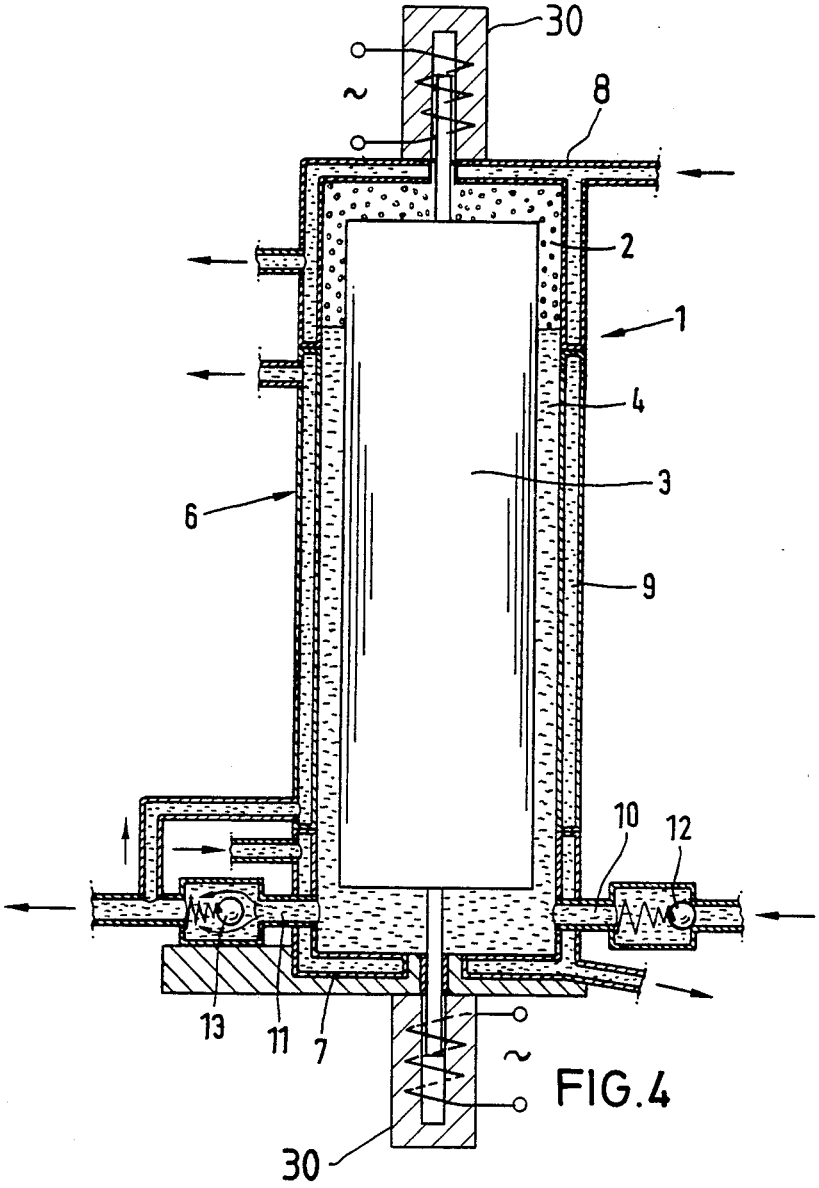
FIG. 4 shows a schematic side view of a third embodiment of a device according to the present invention, the displacement element in the vessel thereof being shown in a fourth operational position.

FIG. 4 shows an electromagnetic drive 30 for periodic upward and downward motion of the displacement element 3, which can be mounted within the displacement element 3, which device exhibits the special advantage that the work space 2 is completely closed so that there is an even greater guarantee against an undesired leaking of the liquid.

The invention offers the advantage of an operationally reliable method, since no highly stressed wearable parts such as membranes are required. The device of the invention also has the advantage that its method of operation is especially rapid and efficient.

What is claimed is:

1. A process for conveying boilable liquids wherein the required delivery pressure is generated by alternately changing the boiling pressure of a boilable liquid from a low starting point to a boiling pressure, increased by the desired increase in pressure by an external heat input and then the original state is reproduced by reducing the pressure to the low boiling pressure by dissipating the heat externally, wherein in the vessel through which the boilable liquid to be conveyed flows, a subquantity of the boilable liquid to be conveyed is subjected directly to the work performing cyclic process in the wet steam region.

2. A process for conveying boilable liquids wherein the required delivery pressure is generated by alternately changing the boiling pressure of a boilable liquid from a low starting point to a boiling pressure, increased by the desired increase in pressure, by an external heat input and then the original state is reproduced by reducing the pressure to the low boiling pressure by dissipating the heat externally, whereby the boilable liquid is subjected to a work performing cyclic process in the wet steam region, which process comprises a reduction in pressure by means of dissipation of heat, compression by means of dissipating heat to a low temperature level, increase in pressure by means of heat input, as well as an expansion at a high temperature level through heat input, wherein in the vessel through which the boilable liquid to be conveyed flows, a subquantity of the boilable liquid to be conveyed is subjected directly to the work performing cyclic process in the wet steam region.

3. A process for increasing the pressure of a boilable liquid from a low pressure to a high pressure and for conveying the boilable liquid from a low pressure portion of a sorption system into a high pressure portion of a sorption system using a device which includes a vessel that has a bottom portion maintained at a low temperature and a top portion maintained at a high temperature, a valved inlet pipe connected to the bottom portion of the vessel, a valved outlet pipe connected to the bottom portion of the vessel, and a displacement element movably positioned in the vessel, said process comprising:

(1) moving the displacement element from a lowermost position within the vessel upwardly to an uppermost position so that (a) a phase boundary between liquid and steam phases of the boilable liquid which is located in the top portion of the vessel will move downwardly to the bottom portion, thereby giving up heat, (b) boilable liquid at low pressure will then flow through the inlet pipe into the vessel, and (c) steam from the steam phase will liquefy, and (2) moving said displacement element from the uppermost position within the vessel back to the lowermost position so that the phase boundary will move back up to the top portion of the vessel and thus be subjected to a high temperature and the pressure of the boilable liquid will increase to said high pressure and will flow out of said outlet pipe.

4. A device for conveying boilable liquids in a sorption system which comprises a vessel which defines a working space therein and which has a lower region, a middle region and an upper region, valved inlet means connected to said vessel in its lower region for supplying a boilable liquid at a low pressure to the working space therein, valved outlet means connected to said vessel in its lower region for removing a boilable liquid at a high pressure from the working space therein, means for maintaining said upper region of said vessel at a higher temperature than said lower region, and displacement means movably positioned in said working space to control the location of a phase boundary between liquid and steam phases of said boilable liquid within said working space.

5. A device according to claim 4, including drive means connected to said displacement means to periodically move said displacement means within said working space of said vessel.

6. A device according to claim 5, wherein said drive means comprises a hydraulic drive unit.

7. A device according to claim 5, wherein said drive means comprises an electromagnetic drive unit.

8. A device according to claim 4, wherein each of said inlet and outlet means includes a one-way back pressure valve therein.

9. A device according to claim 4, wherein said vessel comprises inner and outer walls which provide a fluid space therebetween, wherein partitions are provided between said inner and outer walls to provide a lower heat exchanger zone and an upper heat exchanger zone, and including pairs of inlet and outlet pipes connected to the outer wall of said vessel to enable cold fluid medium to flow through said lower heat exchanger zone and hot fluid medium to flow through said upper heat exchanger zone.

10. A device according to claim 9, wherein said partitions provide a middle heat exchanger zone between said upper and lower heat exchanger zones, and wherein said outlet means includes a branch line which connects to said outer wall of said vessel to enable boilable liquid at high pressure to flow upwardly through said middle heat exchanger and thereby provide a temperature gradient along the inner wall of said vessel.

* * * * *